US008196411B2

(12) United States Patent
Wilbraham

(10) Patent No.: US 8,196,411 B2
(45) Date of Patent: Jun. 12, 2012

(54) SWIRLER WITH WEDGE SHAPED VANES HAVING SPLIT TRAILING EDGE

(75) Inventor: Nigel Wilbraham, West Midlands (GB)

(73) Assignee: Siemens Aktiengesellschaft, München (DE)

( * ) Notice: Subject to any disclaimer, the term of this patent is extended or adjusted under 35 U.S.C. 154(b) by 507 days.

(21) Appl. No.: 12/227,082

(22) PCT Filed: Mar. 16, 2007

(86) PCT No.: PCT/EP2007/052516

§ 371 (c)(1),
(2), (4) Date: Nov. 6, 2008

(87) PCT Pub. No.: WO2007/131818

PCT Pub. Date: Nov. 22, 2007

(65) Prior Publication Data

US 2009/0320485 A1 Dec. 31, 2009

(30) Foreign Application Priority Data

May 12, 2006 (GB) ..... 0609460.1

(51) Int. Cl.
*F02C 1/00* (2006.01)

(52) U.S. Cl. ..... 60/748; 60/737; 60/740; 239/399

(58) Field of Classification Search ..... 60/748, 60/752, 754–760; 239/399
See application file for complete search history.

(56) References Cited

U.S. PATENT DOCUMENTS

| | | | | |
|---|---|---|---|---|
| 3,980,233 | A * | 9/1976 | Simmons et al. | 239/400 |
| 5,647,200 | A * | 7/1997 | Althaus | 60/39.17 |
| 5,827,054 | A | 10/1998 | Sarv et al. | |
| 5,899,075 | A | 5/1999 | Dean et al. | |
| 6,141,967 | A | 11/2000 | Angel et al. | |
| 6,655,145 | B2 * | 12/2003 | Boardman | 60/737 |
| 6,691,516 | B2 * | 2/2004 | Stuttaford et al. | 60/737 |

FOREIGN PATENT DOCUMENTS

| | | |
|---|---|---|
| EP | 0 690 264 A2 | 1/1996 |
| GB | 2 293 001 A | 3/1996 |

* cited by examiner

*Primary Examiner* — William H Rodriguez
*Assistant Examiner* — Carlos A Rivera

(57) ABSTRACT

Disclosed is a swirler for use in a burner of a gas turbine engine, the swirler comprising a pluralkity of vanes arranged in a circle, flow slots being defined between adjacent vanes in a circle, each flow slot having an inlet end and an outlet end, in use of the swirler a flow of air and fuel traveling along each flow slot fom its inlet end to its outlet end such that the swirler provides a swirling mix of the air and fuel, at least one vane being configured to generate a flow vortex that extends from an edge of the vane adjacent an outlet end of a flow slot to within the swirling mix thereby to improve the mix of air and fuel in the swirling mix.

2 Claims, 5 Drawing Sheets

SWIRLER WITH WEDGE SHAPED VANES HAVING SPLIT TRAILING EDGE

CROSS REFERENCE TO RELATED APPLICATIONS

This application is the US National Stage of International Application No. PCT/EP2007/052516, filed Mar. 16, 2007 and claims the benefit thereof. The International Application claims the benefits of British application No. 0609460.1 filed May 12, 2006, both of the applications are incorporated by reference herein in their entirety.

FIELD OF INVENTION

The present invention relates to a swirler for use in a burner of a gas turbine engine.

SUMMARY OF INVENTION

More particularly the present invention relates to such a swirler comprising a plurality of vanes arranged in a circle, flow slots being defined between adjacent vanes in the circle, each flow slot having an inlet end and an outlet end, in use of the swirler a flow of air and fuel travelling along each flow slot from its inlet end to its outlet end such that the swirler provides a swirling mix of the air and fuel.

It is desired to improve the mix of air and fuel in the swirling mix.

According to the present invention there is provided a swirler for use in a burner of a gas turbine engine, the swirler comprising a plurality of vanes arranged in a circle, flow slots being defined between adjacent vanes in the circle, each flow slot having an inlet end and an outlet end, in use of the swirler a flow of air and fuel travelling along each flow slot from its inlet end to its outlet end such that the swirler provides a swirling mix of the air and fuel, at least one vane being configured to generate a flow vortex that extends from an edge of the vane adjacent an outlet end of a flow slot to within the swirling mix thereby to improve the mix of air and fuel in the swirling mix.

In a swirler according to the preceding paragraph, it is preferable that the at least one vane is configured to generate flows of air/fuel within an adjacent flow slot that differ in direction at the outlet end of the slot.

In a swirler according to the preceding paragraph, it is preferable that the at least one vane includes at least one ledge that extends along an adjacent flow slot generally in the direction that air/fuel travels along the slot, the at least one ledge operating to generate first and second air/fuel flows that differ in direction at the outlet end of the slot.

In a swirler according to the preceding paragraph, it is preferable that the at least one vane includes: a first ledge that extends along a first adjacent flow slot generally in the direction that air/fuel travels along the first slot; and a second ledge that extends along a second adjacent flow slot generally in the direction that air/fuel travels along the second slot, the first ledge operating to generate first and second air/fuel flows that differ in direction at the outlet end of the first slot, the second ledge operating to generate third and fourth air/fuel flows that differ in direction at the outlet end of the second slot.

In a swirler according to the preceding paragraph, it is preferable that fuel is supplied to the first slot from both sides of the first ledge adjacent the inlet end of the slot.

In a swirler according to the preceding paragraph but one, it is preferable that fuel is supplied to the first slot from one side of the first ledge at spaced positions along the first ledge.

In a swirler according to the preceding paragraph but two, it is preferable that fuel is supplied to the first slot from the end of the first ledge adjacent the outlet end of the slot.

In a swirler according to the preceding paragraph, it is preferable that the fuel supplied is liquid fuel, and it is supplied by means of a liquid fuel injection nozzle.

In a swirler according to the preceding paragraph but four, it is preferable that the side of the at least one vane including the first ledge is curved on one side of the first ledge thereby to increase the size of the first ledge, and fuel is supplied to the first slot from the first ledge.

In a swirler according to the preceding paragraph but five, it is preferable that the side of the at least one vane including the first ledge is curved on both sides of the first ledge thereby to increase the size of the first ledge, and fuel is supplied to the first slot from the first ledge.

In a swirler according to any one of the preceding ten paragraphs, it is preferable that each vane is wedge shaped, and the wedge shaped vanes are arranged in the circle such that the thin ends of the wedge shaped vanes are directed generally radially inwardly, the opposite broad ends of the wedge shaped vanes face generally radially outwardly, and the flow slots defined between adjacent vanes are directed generally radially inwardly.

BRIEF DESCRIPTION OF THE DRAWINGS

The invention will now be described, by way of example, with reference to the accompanying drawings, in which.

DETAILED DESCRIPTION OF INVENTION

Figure 1:
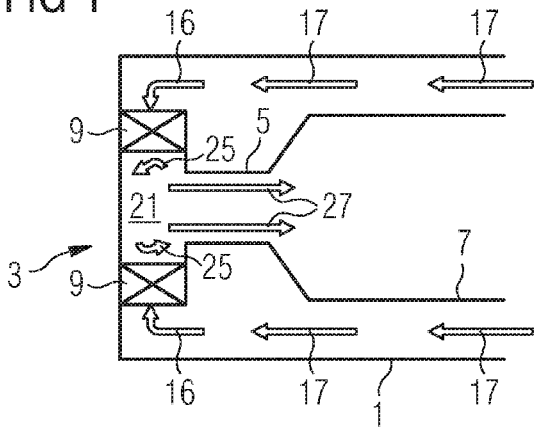
FIG. 1 is a schematic section through a burner for a gas turbine engine, which burner includes a radial swirler in accordance with the present invention.

Referring to FIG. 1, the burner comprises an outer casing 1, a radial swirler 3, a pre-chamber 5, and a combustion chamber 7.

Figure 2:
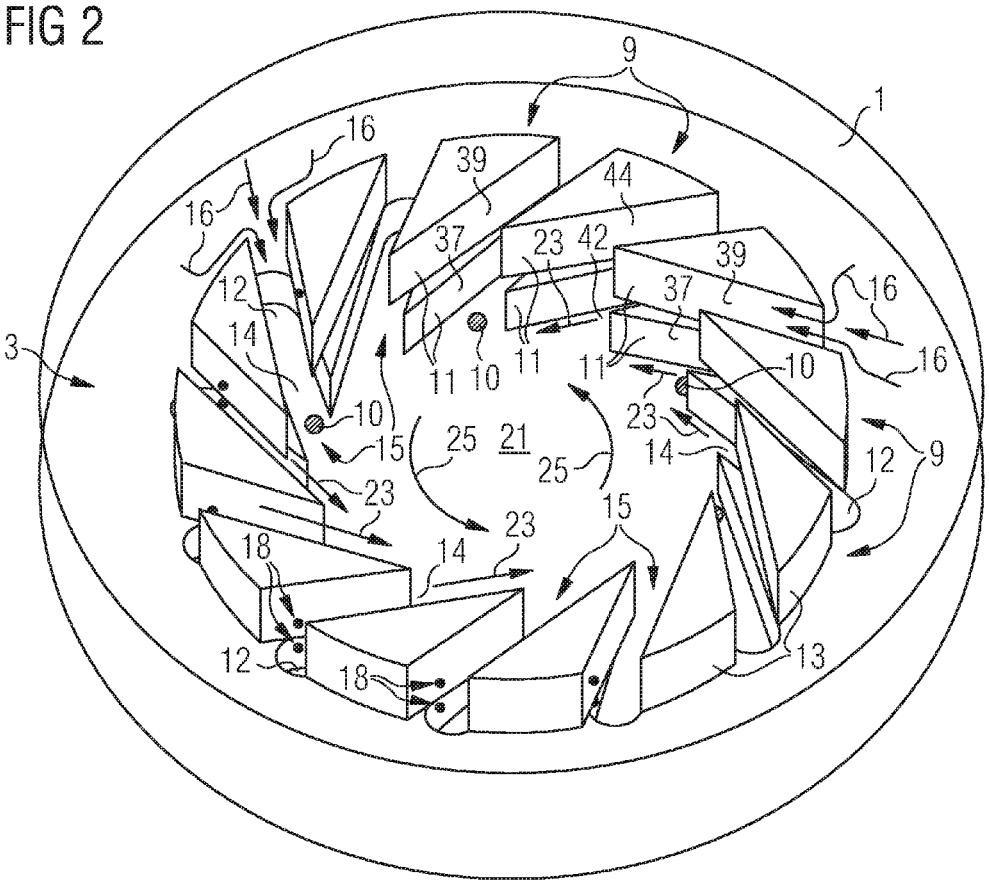
FIG. 2 is a perspective view of the swirler of FIG. 1.

Referring also to FIG. 2, radial swirler 3 comprises a plurality of wedge shaped vanes 9 arranged in a circle. The thin ends 11 of the wedge shaped vanes are directed generally radially inwardly. The opposite broad ends 13 of the wedge shaped vanes face generally radially outwardly. Generally radially inwardly directed flow slots 15 are defined between adjacent wedge shaped vanes 9 in the circle. Each flow slot 15 has a base 42 and a top 44 spaced apart in a direction perpendicular to the plane of the circle in which the wedge shaped vanes 9 are arranged. Each flow slot 15 has an inlet end 12 and an outlet end 14.

Compressed air travels in the direction of arrows 17 in FIG. 1 between outer casing 1 and combustion chamber 7/pre-chamber 5. As indicated by arrows 16, the air then turns through 90 degrees so as to enter the flow slots 15 at their inlet ends 12. The air then travels generally radially inwardly along flow slots 15 to their outlet ends 14. Liquid fuel is supplied to every other flow slot 15 by way of fuel injection holes 10 in the bases 42 of these flow slots. Further, gaseous fuel is supplied to every flow slot 15 by way of two fuel injection holes 18 in a side of each wedge shaped vane 9. The air/fuel mix enters the central space 21 within the circle of wedge shaped vanes 9 generally in the direction as indicated by arrows 23, thereby to form a swirling air/fuel mix 25 in central space 21. As indicated by arrows 27, the swirling air/fuel mix 25 travels along pre-chamber 5 to combustion chamber 7 where it combusts.

Figure 3:
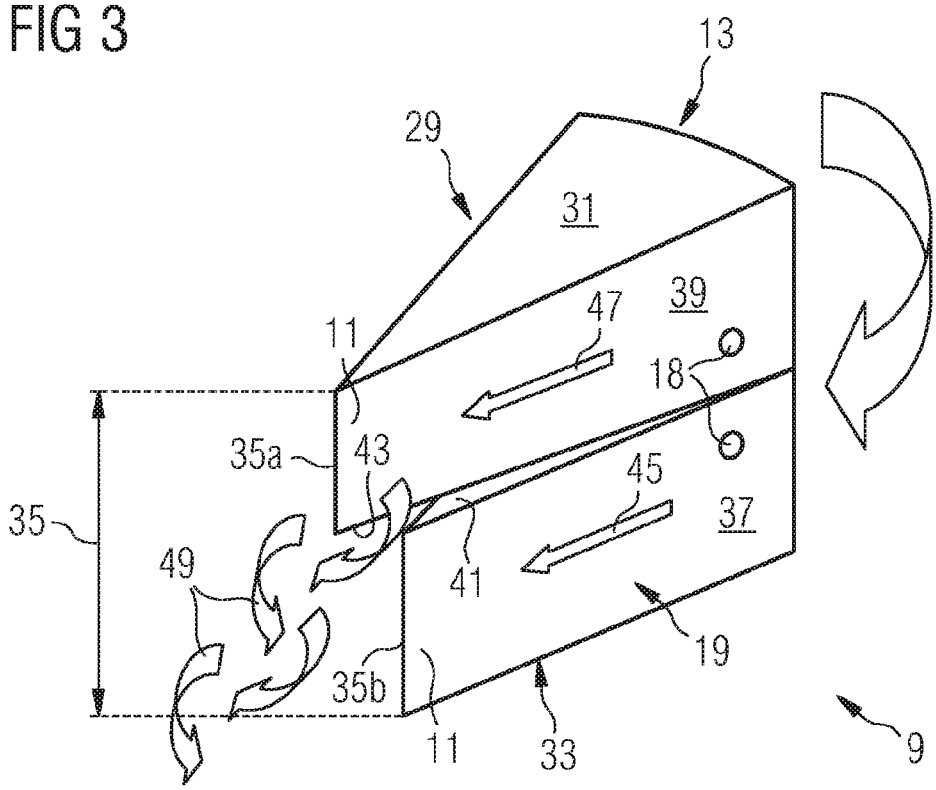
FIG. 3 shows a single wedge shaped vane of the swirler of FIG. 1.

Referring also to FIG. 3, each wedge shaped vane 9 comprises a thin end 11, a broad end 13, a first side 19, a second side 29, a top face 31, and a bottom face 33. The edge 35 at the thin end 11 is split into two sections 35*a*, 35*b*. The split is created by forming wedge shaped vane 9 from lower and upper component wedge shaped vanes 37, 39 that are slightly out of register with respect to one another thereby to create ledges 41, 43 within the first and second sides 19, 29 of the wedge shaped vane 9. The ledge 41 is created on the top face of lower component wedge shaped vane 37 in the flow slot 15 adjacent first side 19. The ledge 43 is created on the bottom face of upper component wedge shaped vane 39 in the flow slot 15 adjacent second side 29. Two gaseous fuel injection holes 18 are located as shown in first side 19, one hole in lower component wedge shaped vane 37, the other in upper component wedge shaped vane 39.

Ledge 41 operates to create first and second flows of air/fuel 45,47 over first side 19 of wedge shaped vane 9, which flows 45, 47 differ slightly in direction thereby to create a shear between the two flows. Ledge 43 operates in corresponding manner in respect of second side 29 of wedge shaped vane 9. The four flows combine at edge 35 to create a vortex 49 that extends from edge 35 to within the circle of wedge shaped vanes 9. Vortex 49 improves the mix of fuel and air in the swirling mix within the circle of vanes.

Figure 4:
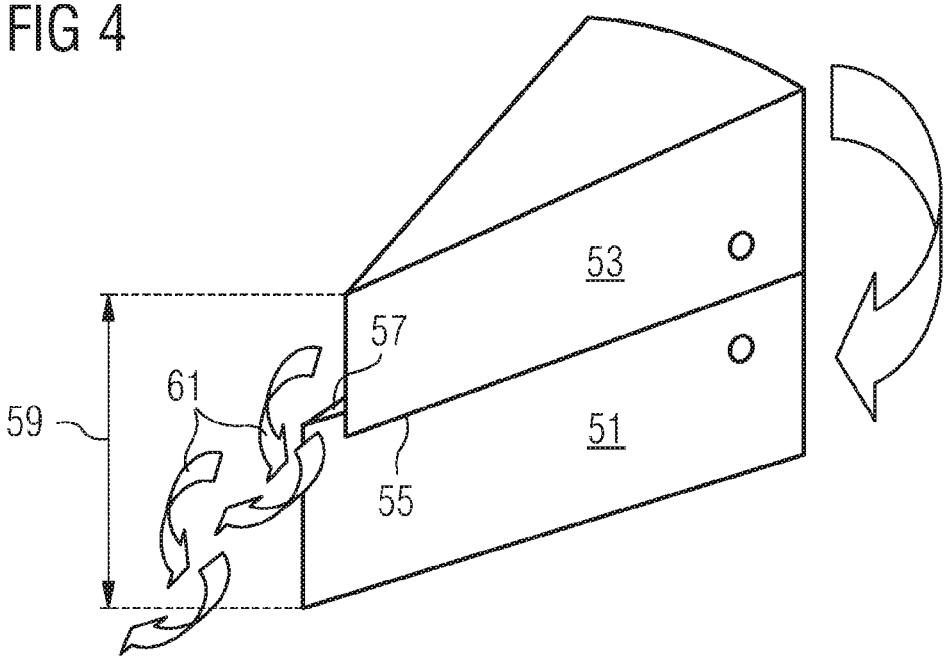
FIGS. 4 to 10 all show alternative wedge shaped vanes to that of FIG. 3.

The alternative wedge shaped vane of FIG. 4 is the same as that of FIG. 3 except that the lower and upper component wedge shaped vanes 51, 53 of the FIG. 4 vane are out of register with respect to one another in the opposite sense to the FIG. 3 vane. It can be seen from FIG. 2 that the upper component wedge shaped vanes 39 of the FIG. 3 vanes are displaced in an anticlockwise sense with respect to the lower component wedge shaped vanes 37 of the FIG. 3 vanes. In the alternative wedge shaped vane of FIG. 4, upper component wedge shaped vane 53 is displaced in a clockwise sense with respect to lower component wedge shaped vane 51.

The alternative wedge shaped vane of FIG. 4 operates in corresponding manner to the wedge shaped vane of FIG. 3. Thus, ledges 55, 57 create four flows of air/fuel that combine at edge 59 to create vortex 61 which improves the mix of fuel and air.

Figure 5:
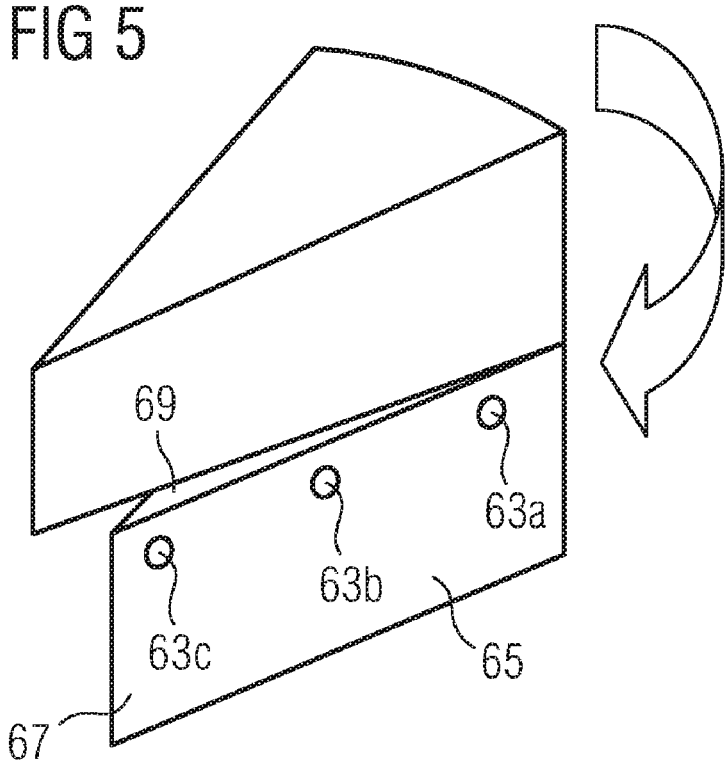

The alternative wedge shaped vane of FIG. 5 is the same as that of FIG. 3 except that the gaseous fuel injection holes are located differently. In the FIG. 5 vane three gaseous fuel injection holes 63*a*, 63*b*, 63*c* are all located in a side 65 of lower component wedge shaped vane 67. The holes 63*a*, 63*b*, 63*c* are located at spaced positions along the length of the flow slot adjacent side 65, immediately below ledge 69 on the top face of lower component wedge shaped vane 67. During low load operation of the gas turbine engine, when less fuel is required, only hole 63*a* might be used for fuel injection. During mid load operation, holes 63*a* and 63*b* might be used. During high load operation, when most fuel is required, all three holes 63*a*, 63*b*, 63*c* might be used.

Figure 6:
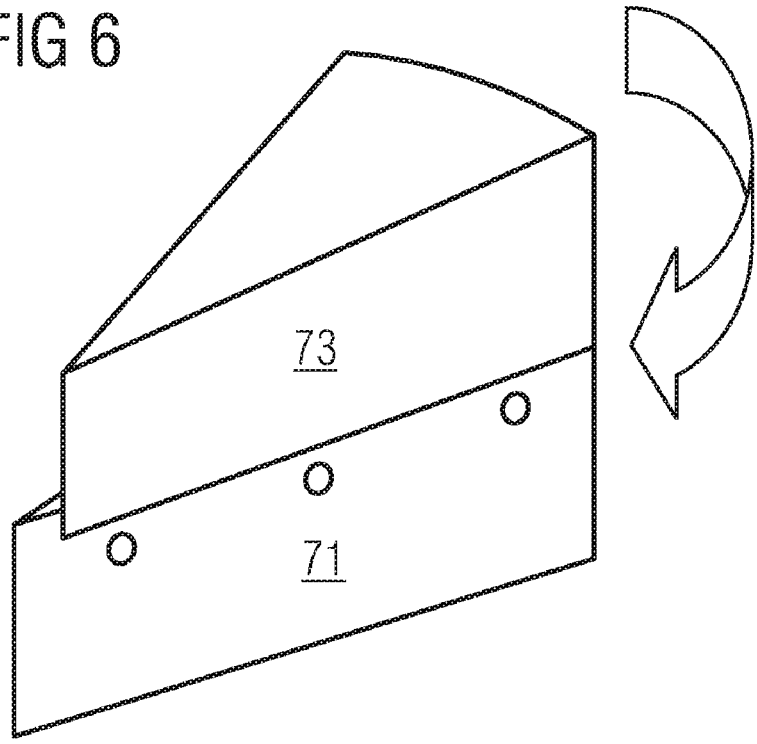

The alternative wedge shaped vane of FIG. 6 is the same as that of FIG. 5 except that the lower and upper component wedge shaped vanes 71, 73 of the FIG. 6 vane are out of register with respect to one another in the opposite sense to the FIG. 5 vane.

Figure 7:
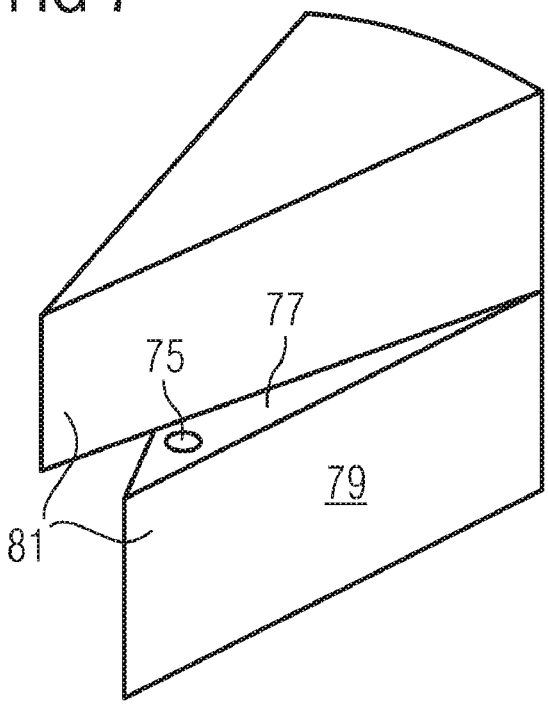

The alternative wedge shaped vane of FIG. 7 is the same as that of FIG. 3 except that the FIG. 7 vane has only one gaseous fuel injection hole 75, and this is located in the ledge 77 on the top face of lower component wedge shaped vane 79. The hole 75 is located at the end of the ledge at the thin end 81 of the FIG. 7 vane. It is to be noted that hole 75 is located at the base of the vortex generated at the thin end 81 of the FIG. 7 vane, see FIG. 3. Thus, the fuel injected via hole 75 is very efficiently taken up by the vortex thereby enhancing the mixing of the injected fuel with air. The lower and upper component wedge shaped vanes of the FIG. 7 vane could of course be out of register with respect to one another in the opposite sense to that shown in FIG. 7.

Figure 8:
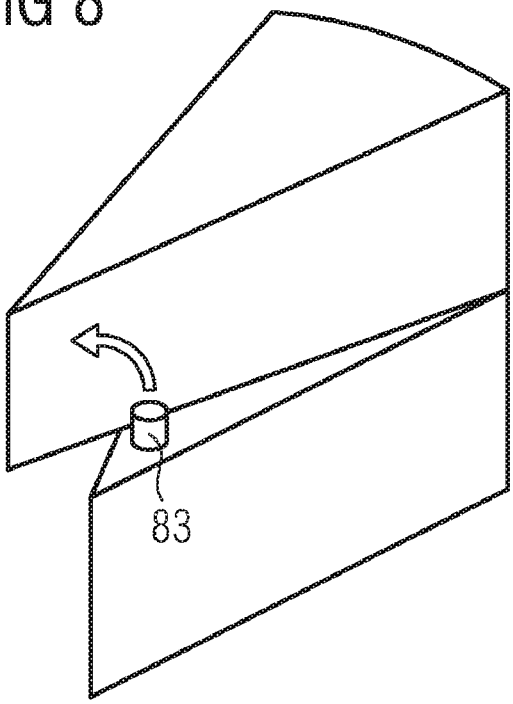

The alternative wedge shaped vane of FIG. 8 is the same as that of FIG. 7 except that the gaseous fuel injection hole 75 of FIG. 7 is replaced by a liquid fuel injection nozzle 83. The advantage of this is that fuel may be injected to a greater height within the flow slot containing nozzle 83, when this is required. As in the case of the FIG. 7 vane, the lower and upper component wedge shaped vanes of the FIG. 8 vane could be out of register with respect to one another in the opposite sense to that shown in FIG. 8.

Figure 9:
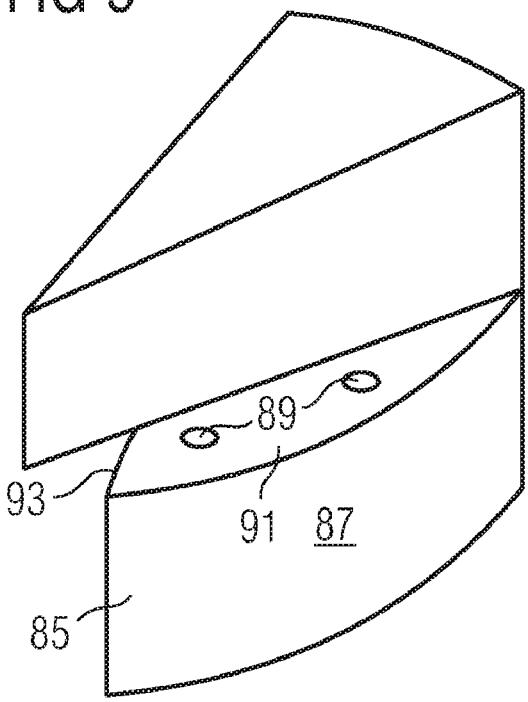

The alternative wedge shaped vane of FIG. 9 is the same as that of FIG. 3 except that: (i) a side 85 of the lower component wedge shaped vane 87 of the FIG. 9 vane is curved; and (ii) the two gaseous fuel injection holes 18 of the FIG. 3 vane are replaced by two gaseous fuel injection holes 89 in ledge 91 on the top face of lower component wedge shaped vane 87. Curved side 85 has the advantage that it provides more room for the location of gaseous fuel injection holes in ledge 91. In this regard, it is to be noted that fuel injected at ledge 91 is very efficiently taken up by the vortex generated at the thin end of the FIG. 9 vane, thereby enhancing the mixing of the injected fuel with air. The lower and upper component wedge shaped vanes of the FIG. 9 vane could be out of register with respect to one another in the opposite sense to that shown in FIG. 9. In this case the curved side of the lower component wedge shaped vane 87 would not be side 85, but would be side 93 opposite side 85.

Figure 10:
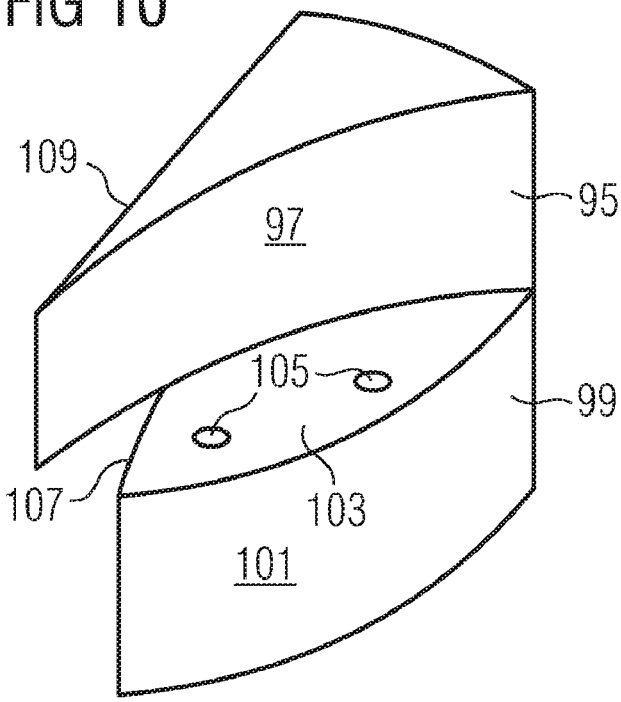

The alternative wedge shaped vane of FIG. 10 is the same as that of FIG. 9 except that a side 95. of the upper component wedge. shaped vane 97 is curved. This side 95 is on the same side of the FIG. 10 vane as the curved side 99 of the lower component wedge shaped vane 101, and is above the ledge 103 of the FIG. 10 vane. The advantage of curved side 95 is that it further increases the room available on ledge 103 for gaseous fuel injection holes 105. As in the case of the FIG. 9 vane, the lower and upper component wedge shaped vanes of the FIG. 10 vane could be out of register with respect to one another in the opposite sense to that shown in FIG. 10. In this case the curved side of the lower component wedge shaped vane 101 would not be side 99, but side 107 opposite side 99, and the curved side of the upper component wedge shaped vane 97 would not be side 95, but side 109 opposite side 95.

The above description relates to a radial swirler. It is to be appreciated that the present invention also extends to axial swirlers. Axial swirlers also comprise a plurality of vanes arranged in a circle, flow slots being defined between adjacent vanes in the circle, each flow slot having an inlet end and an outlet end, in use of the swirler a flow of air and fuel travelling along each flow slot from its inlet end to its outlet end such that the swirler provides a swirling mix of the air and fuel. Use of the present invention in an axial swirler would require at least one vane of the swirler to be configured to generate a flow vortex that extends from an edge of the vane adjacent an outlet end of a flow slot to within the swirling mix thereby to improve the mix of air and fuel in the swirling mix.

The invention claimed is:

1. A swirler for use in a burner of a gas turbine engine, comprising:

a plurality of wedge shaped vanes arranged in a circle, the wedge shaped vanes each having a thin end disposed radially inwardly, a broad end opposite the thin end disposed radially outwardly, a first side arranged between the thin and broad ends, a second side opposite the first side;

a plurality of radially directed flow slots defined between adjacent vanes in the circle, wherein each flow slot extends from a radially outward facing inlet to a radially inward facing outlet, to direct an air flow towards a central space within the circle, wherein fuel is supplied into the flow slot, such that a mixture of fuel and air enters the central space, wherein an edge at the thin end of at least one vane is split into two sections, the split created by forming wedge shaped vanes from lower and upper component wedge shaped vanes that are oriented with an angular offset with respect to one another to create first and second ledges within the first and second sides of the wedge shaped vanes, and wherein the fuel is supplied to the flow slot from at least one of the said first and second sides and from both said lower and upper component wedge shaped vanes that are oriented with said angular offset with respect to one another.

2. The swirler according to claim 1, wherein the fuel is supplied to a flow slot from both sides of the first ledge adjacent the inlet end of the slot.

* * * * *